US009174356B2

(12) United States Patent
Budi

(10) Patent No.: US 9,174,356 B2
(45) Date of Patent: Nov. 3, 2015

(54) METHOD OF WOOD PRESERVATION USING EXPIRATION CONTROL

(75) Inventor: Santoso Budi, Bogor (ID)

(73) Assignee: PT. KARUNA SUMBER JAYA, Bogor (ID)

( * ) Notice: Subject to any disclaimer, the term of this patent is extended or adjusted under 35 U.S.C. 154(b) by 54 days.

(21) Appl. No.: 13/882,250

(22) PCT Filed: Nov. 21, 2011

(86) PCT No.: PCT/ID2011/000007

§ 371 (c)(1),
(2), (4) Date: Jun. 20, 2013

(87) PCT Pub. No.: WO2013/014657

PCT Pub. Date: Jan. 31, 2013

(65) Prior Publication Data

US 2014/0147640 A1 May 29, 2014

(30) Foreign Application Priority Data

Jul. 27, 2011 (ID) ..... P00201100446

(51) Int. Cl.

| | |
|---|---|
| ***B27K 5/04*** | (2006.01) |
| ***B65D 19/38*** | (2006.01) |
| ***B27K 3/02*** | (2006.01) |
| ***B27K 5/00*** | (2006.01) |

(52) U.S. Cl.

CPC ..... *B27K 5/04* (2013.01); *B27K 3/0278* (2013.01); *B27K 5/00* (2013.01); *B65D 19/38* (2013.01); *B65D 2519/00009* (2013.01); *B65D 2519/0086* (2013.01); *Y10T 29/49826* (2015.01); *Y10T 428/24802* (2015.01)

(58) Field of Classification Search

CPC ..... B27K 5/04

See application file for complete search history.

(56) References Cited

U.S. PATENT DOCUMENTS

| | | | | |
|---|---|---|---|---|
| 6,174,036 | B1 | 1/2001 | Aman | |
| 6,187,234 | B1 * | 2/2001 | Bonomo et al. | 264/83 |
| 6,529,799 | B1 | 3/2003 | Paulk | |
| 7,678,309 | B2 | 3/2010 | Jarck | |
| 2006/0289087 | A1 | 12/2006 | Lachance | |
| 2007/0184296 | A1 * | 8/2007 | Besner et al. | 428/541 |

* cited by examiner

*Primary Examiner* — Nathan T Leong

(74) *Attorney, Agent, or Firm* — Adam Warwick Bell; Matthew Kaser

(57) ABSTRACT

A method to preserve packed wood by expiration controlling consists of following steps: to clean/smooth surface of packed wood by a cleaner/by sanding said wood surface; to dry moisture of clean packed wood by heating in a high temperature oven; to assemble/manufacture a packed wood according to designed/required shape; to immunize wood preservatives by dipping in pool contains preservation liquid in certain dosage; to dry by draining the preservatives of packed wood that dipped in said preservation liquid pool; and to put security symbols on packed wood before shipping/distribution.

10 Claims, 2 Drawing Sheets

METHOD OF WOOD PRESERVATION USING EXPIRATION CONTROL

TECHNICAL FIELD

Present invention relates to a method to preserve a packed wood using expiration control, more particularly to a method to preserve a packed wood which is eco-friendly, giving measurable preservatives for one month, thus avoid other's live destruction, except destroy fungus, dangerous gulmae and parasite on said packed wood.

BACKGROUND OF INVENTION

*International Standard Phytosanitary Measure* 15 (ISPM #15) has been stipulated by *International Plant Protection Convention* (IPPC) to packed wood in international trade. ISPM #15 regulation is meant to avoid pest transfer or migration from a place to another or from a country to another country. Besides, ISPM #15 avoids one party side of each country releases a regulation of packed wood exportation and importation. Some target of pest according to ISPM #15 are anobidae, bostrichidae, buprestidae, curculionidae, isoptera, lictidae, oedemeridae, scolytidae, siricidae, and nematodes.

Further ISPM #15 discloses a packed wood shall meet requirement to be free of fungus, pest or living insects, wood crevices by insects, bark, clean, conform with treatment standard of *Badan Karantina Pertanian* [BARANTAN] or Plant Quarantine Agency, and anti-weathered/fungus.

Wood may be applied widely, as industry material, home furniture, writing utensils even a structural frame etc. Otherwise, wood is highly difficult to use and apply in a long term, particularly outdoor application, due to it will be destroyed by the weather such as obsolescent (fungus) and *Organisme Pengganggu Tumbuhan* (OPT) or Plant Disturber Organisms. According to present invention, the wood used as packed wood is applied domestic and overseas. Exporting packed wood shall conform ISPM #15. One kind of wood preservation, particularly to manufacturing wood package, is giving a copper compound which is water-soluble. A problem occurs by said water-soluble copper compound that impregnate into wood then press and make said copper compound enter into wood's pores. Even if said packed wood is exposed by rain drops, the copper compound exits packed wood's pores then create environmental damage due to outdoor usage.

Oxalic acid as a simple carboxylic acid has been found in almost organisms including plant, animal and fungus. Basidiomycetes class of fungus as main agent in wood degradation (lignoselulosa) produces a number of oxalic acid during wood colonization. Said oxalic acid known having crucial role in wood components degradation. Oxalic acid of fungus functions as protein source in wood cellulose hydrolysis, whether enzyme or non-enzyme, by reducing pH of said wood and accelerate cellulose de-polymerization thus eliminate wood's strength. From wood preservation view, fungus produces oxalic is harmful to wood's strength, in packed wood manufacturing. Property of strong binder to metal of oxalic acid according to previous invention is copper-chrome-arsenat (CCA), which is used commonly in wood preservation. The CCA becomes less effective to avoid fungus attack, thus achievement in finding specific inhibitor to oxalic acid biosynthesize into fungus meets inventive step aspect.

It has been applied in long period to produce a packed wood by small entities, traditional craftsmen and medium industries. Disclosed that method to preserve a packed wood by providing the copper (Cu) substance which has derivatives such as copper-chrome-arsenat (CCA) dan copper-citrate (CC). Using any one of said substance without mixing said substances causes inactivation of packed wood preservation.

Another disclosed method to preserve wood according to existent standard is fumigation and heat treatment. Current heat treatment is to heat at least 56° C. for 30 minutes. This requires lot of energy, big consumption of energy creates global warming. Current fumigation uses Methyl Bromide ($CH_3Br$) gas for 24 hours and temperature at least 10° C. with 48 gr/$m^3$ dosage. Note that Methyl Bromide ($CH_3Br$) is one of ozone destroyer. Nevertheless, Methyl Bromide ($CH_3Br$) is kept to be used in quarantine operation, especially in plant quarantine (with tight supervision and conform to law). Meanwhile, Methyl Bromide (CH3Br) replacement may be used, for example Cold Treatment, Heat Treatment, fumigasi with fospin, Sulfur Flouride, Ethylene Oxide other alternative eco-friendly substances.

From above disclosure, resuming that methods to preserve wood, particularly packed wood, have some weaknesses or obstacles that destroy environment by using such dangerous chemical substances (pesticides) uncontrollably and immeasurably. Besides, inactivation, ozone destruction, and oxalic acid decrease wood's strength.

Based on said problems, weaknesses, obstacles of current invention, inventors propose a method to preserve packed wood by a novel method combining heat treatment and immunization using preservatives in measurable dosage for one month since dipping in thus re-immunization in next months of expiration phase.

BRIEF DESCRIPTION

As disclosed before, present invention relates to a method to preserve packed wood by expiration controlling.

A method to preserve packed wood by expiration controlling according to present invention consists of steps:

to dry moisture of clean packed wood by heating in a high temperature oven;

to clean/smooth surface of packed wood by a cleaner/by sanding said wood surface;

to assemble/manufacture a packed wood according to designed/required shape;

to immunize wood preservatives by dipping in pool contains preservation liquid in certain dosage;

to dry by draining the preservatives of packed wood that dipped in said preservation liquid pool; and to put security symbols on packed wood before shipping/distribution.

Present invention goals to provide a method to preserve a packed wood by expiration controlling, within relatively short period of time, efficient, easy to implement, eco-friendly, cheap and also assure said packed wood to be avoided from OPT and fungus attack.

Another goal of present invention is to provide a method to preserve packed wood by expiration controlling, which expiration controlling is intended to give a certain dosage of preservative ingredients that harmless to environment within thirty days or one month. Because, if the pesticide-contained preservatives or harmful substances exist in said packed wood for more than thirty days, such preservatives shall endanger living things, in other words, they destruct living things and ecosystem.

Further goal of present invention is to provide a method to preserve packed wood by expiration controlling, which preservatives composition consists of friendly substances to living things, that in some extent according to present invention merely diminish fungus on packed wood or pests, but harmless to living things, so that said preservatives are eco-friendly preservatives.

Another goal of present invention is to provide a packed wood with securing symbols of numbers, security label, symbols, date of immunization, and also month and year of production on its cover.

Further goal of present invention is to provide a packed wood with symbols to ease users to read last immunization process and to control, since immunization should be redo within 30 days from said immunization (one month). This is deemed expired if a packed wood is not treated more than one month from last immunization and not yet kept in a container or carrier.

Duration of shipping in a container/freight ship does not count in immunization/expiration process due to the freight vehicles guarantee free of fungus or OPT re-infestation by total cleaning/controlling with disinfectant.

BRIEF OF DRAWINGS

The method to preserve packed wood by expiration controlling according to present invention shall be disclosed with reference to accompany drawings, which:

DETAILED DESCRIPTION

Detailed disclosure of present invention will be described completely with reference to accompanying drawings.

Figure 1:
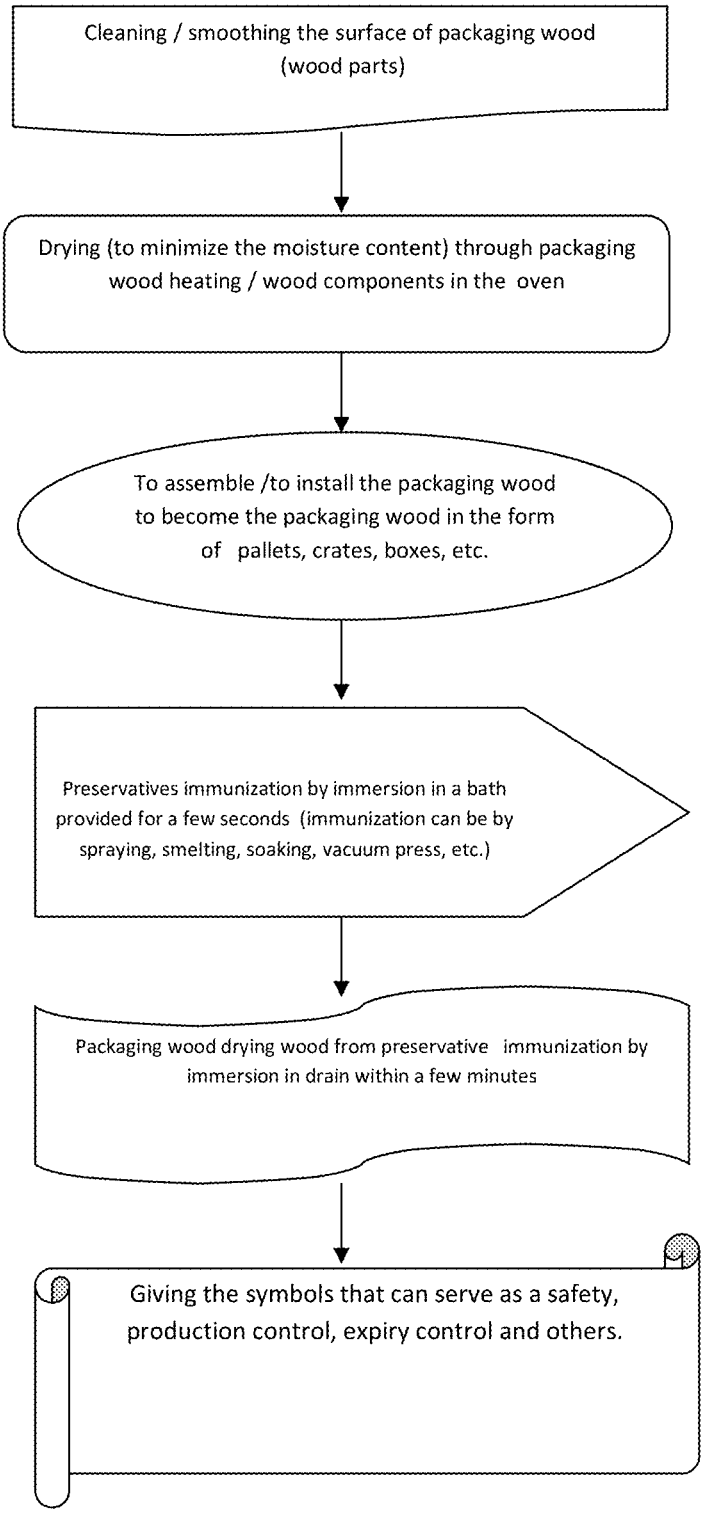
FIG. 1 is a flow chart of steps to preserve packed wood according to a method to preserve by expiration controlling, according to present invention.

Referring to FIG. 1, which is a flow chart of steps to preserve packed wood according to a method to preserve by expiration controlling, according to present invention.

A method to preserve packed wood by expiration controlling according to present invention consists of following steps:

To dry moisture of clean packed wood by heating in a high temperature oven;

To clean/smooth surface of packed wood by a cleaner/by sanding said wood surface;

To assemble/manufacture a packed wood according to designed/required shape;

To immunize wood preservatives by dipping in pool contains preservation liquid in certain dosage;

To dry by draining the preservatives of packed wood that dipped in said preservation liquid pool; and To put security symbols on packed wood before shipping/distribution.

Yet referring to FIG. 1, disclosed that step of cleaning and smooth packed wood's surface is after shaping wood profile to assemble into a desired packed wood. In this case that the sample is in pallet wood shape (see FIG. 2).

After cleaning and smoothing the wood's surface perfectly, next step is dry the wood to reduce moisture of packed wood as least as possible, which said packed wood contains between 80-120% of water, whereas higher moisture heighten possibility of fungus and dangerous bacteria, it is necessary to reduce moisture by putting wood components/profiles into a burner/oven with temperature around of 600° C. to 700° C. for 6 to 7 days continuously, until a very low level of moisture, i.e. less than around ten percent or between 10-19% or even less.

Figure 2:
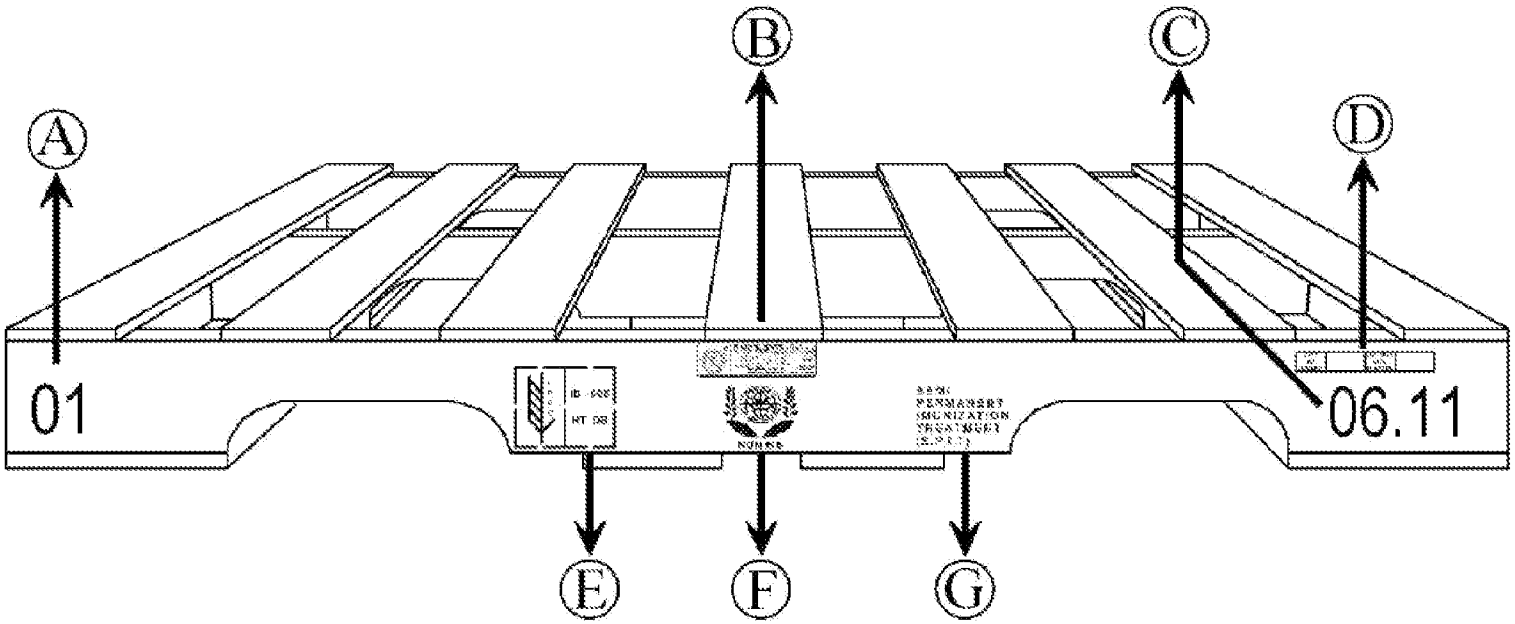
FIG. 2 is a perspective view of one example of complete packed wood by preservation, and entitles symbols on surface of said packed wood, according to present invention.

Next step is to assemble or manufacture a packed wood according to desired or required shape or according to request, as illustrated in present invention in pallet shape of FIG. 2. To assemble said packed wood perfectly with rivets to bind wood components, which said bolt placed by shooting a special tool, so that said rivets enter within packed wood, in order to the head of rivets will not destruct stuffs on it. During manufacturing, all physical aspects of wood profile/components carefully, cracked parts is bond by bolt, then furnished by putty, also defects is puttied in certain way, thus distinguish said defects on packed wood.

Further step is giving a preservative or so-called immunization of wood preservative, by dipping into a pool contains preservative liquid mixture in certain dosage. In this example, immunization is conducted by dipping in, that packed wood is dipped in completely into bottom of pool contains preservative mixture for couple of seconds. In case of immunization is conducted by mixing preservatives controllable and measurable, said preservatives are harmless to living things except fungus and dangerous bacteria to said packed wood. Term "mixing preservatives controllable and measurable" means the dosage is harmless to living things and the life time of said preservatives are less than 30 days or one month, in order to make them eco-friendly, because they will destruct surroundings if stand for more than 30 days (1 month). Therefore, we limit 30 days of life time of said preservatives of packed wood and re-immunization after that by spraying or any other ways. Based on the experiment on rats, none of them dies within 14 days after consuming the preservatives liquid composition. This proved that the preservatives is eco-friendly, thus the preservatives were immunized into packed wood and exhibited the wood were free of fungus and dangerous bacteria.

Next step is to dry packed wood by drain it from packed wood that dipped in pool contains preservatives for a couple of minutes. When the surface is dry, do next step, giving symbols.

Next step is to entitle symbols on outer surface of packed wood before shipping/distribution. These symbols are part of security to faking activity by other parties, and to control re-immunization after expiration date.

Next, referring to FIG. 2, which FIG. 2 is a perspective view of one example of complete packed wood by preservation, and entitle symbols on side surface of said packed wood, according to present invention.

Yet referring to FIG. 2, disclosed an embodiment of manufacturing packed wood into pallet shape, but practically, preserved woods are allowed to various goals, such as box manufacturing, cupboard, and many other packages of wood according to present invention.

Explanation of symbols on packed wood surface, in this case illustrates a pallet packed wood, e.g. two digits of numeral on left side (a), such as "01" numeric (a) shows a sequence number of said pallet, in this case there is no similar two digit at same day for said pallet product. On middle of pallet entitled a securing label (b), which said label (b) contains company address and important message relates to pallet. The label (b) non-unplug, unless destroy the label then suspect to the originality. Then on right side, there are some digits of numeric (c) to show month and year of manufacturing. On upper side of month and year of manufacturing, providing a column (d) displays date of immunization and expiration date of packed wood. Beside such symbols, there is country identity (e), and symbol (f) shows the product is free of methyl bromide, and letters (g) inform that the product is processed by semi-permanent immunization treatment.

In general, preservatives composition use ($CH_3Br$), previous wood composition may be used onto wood surface by submerging and impregnation of necessary pressure application, whether direct or after dilute or emulsion inside water or organic solvent in order to keep fungus and OPT harmless temporarily. Note that methyl bromide is an unfriendly method to environment, enlisted to ozone destroyer group in gas chemical substances, even in excessive usage. Indonesia government by Ministry of Environment and Plant Quarantine Body ascendant hold fumigating warehouse pest regional training. This training is step to eliminate methyl bromide usage and a commitment to environment preservation.

Preservatives composition to immunization according to present invention uses at leas one kind of copper compound of 2 Kg that dispersed in water with Sodium Dichromate of 3 Kg, Borix of 1 Kg. Said preservatives are dissolved with at least 7.5 liters of water. Mixture composition according to present invention yields 80 EC mixture, called as Composition A.

Second composition is at least Acetic Acid of 100 EC, Citrus of 100 EC, also tobacco of 1 Kg to be boiled within 2.5 liters of water to yield 40 EC mixture; 0.5 kg of clove are mixed with 20 liter of water to yield 2.5 EC mixture. Mixture composition according to present invention is called as Composition B.

Third composition is cypermethrin liquid at least 100 EC, called as Composition C.

The three said compositions are mixed into one consist of 2 ml/ltr of Composition A, 2 ml/ltr of Composition B, and 4 ml/ltr of Composition C. Whole composition A, composition B and composition C yield 1 liter of water with 0.8% of water into a disinfectant mixture to immune wood according to present invention.

Mixture according to present invention is called as disinfectant. Said mixture is used by spraying technique, dyeing, brushing, submerging, vacuum pressure, pressure impregnation to woods.

Treatment of wood prior to using disinfectant mixture is heat treatment using heating kitchen having temperature about between 650° C. to 750° C. Whilst the temperature of wood drying kitchen is about 65° C. to 120° C., for 3 to 7 days. This is for reducing wood moisture as least as possible. As information, a raw wood enters heating kitchen reaches 90% to 120% moisture so the wood easy to reinvest OPT and prone to fungus attack. Besides, the heating wood functions to heat temperature of wood core. In general, heating treatment according to standard is 56° C. for ±30 minutes constantly.

Label marking according to present invention is part of method and process to immunize. FIG. 2 explains that label marking signs which wood packed no more than 6 months ago before arrive in destine country/consumers. If immunization date is more than 1 month from first day entering immunization process and the packed is not shipped yet, so the packed shall be pledged expired and require re-immunization and gain new immunization date. Such labeling eases FI-FO (First In First Out) that means the first come will be used first. Security label contains address of packed wood to communicate with user and Non-MB (free of Methyl Bromide which is in Ozone Destroyer List). Therefore, the result package provides a warranty to re-infestation OPT and fungus attack. Process according to present invention is expiration system.

Whole explanation refer to drawings herein and dimensions are intended to be exemplary and not to limit present invention, because other shape and configuration, and dimensions are possible to conduct by person skill in this art after read this description or parts of invention. Therefore, all modifications, configurations and other shapes possible according to present invention are part of protection coverage within appended claims.

What we claim are:

1. A method for preserving wood by immunization of the wood against pests, the method comprising the following steps:

(i) drying the wood by heating in a high temperature oven;

(ii) cleaning and smoothing the surface of the wood by a using a cleaner and by sanding said wood surface;

(iii) assembling the wood;

(iv) immunizing the wood using preservatives, using a mixture comprising copper compounds, sodium dichromate acetic acid, citric acid, tobacco and clove compounds, and Cypermethrin;

(v) further drying the wood; and (vi) marking the wood with security symbols before shipping or distribution.

2. The method of claim 1 wherein the wood is dried to a temperature of between 65° C. to 120° C.

3. The method of claim 1 wherein the duration of drying is from 3 days to 7 days.

4. The method of claim 1 wherein the immunization step is carried out by dipping the wood into a pool containing preservation liquid in certain dosage.

5. The method of claim 1 wherein the immunization step is carried out by spraying, dyeing, brushing, submerging, using vacuum pressure, or pressure impregnation using a preservation liquid.

6. The method of claim 1 wherein the wood is assembled into a pallet.

7. The method of claim 6 wherein the wood is marked with a numeric sequence.

8. The method of claim 1 wherein the immunization step comprises contacting the wood with a disinfectant mixture comprising a mixture of copper compounds and sodium dichromate dissolved in water, acetic acid, citric acid, tobacco and clove compounds, and Cypermethrin.

9. The method of claim 8 wherein the disinfectant mixture contains preservatives that become harmless to living things after less than 30 days.

10. The method of claim 9 wherein the living things are rats.

* * * * *